US005573062A

United States Patent [19]

Ooba et al.

[11] Patent Number: 5,573,062

[45] Date of Patent: Nov. 12, 1996

[54] HEAT TRANSFER TUBE FOR ABSORPTION REFRIGERATING MACHINE

[75] Inventors: Kazuhiko Ooba; Tatsuo Yoshisue; Takeshi Nishizawa; Gou Isobe, all of Tokyo, Japan

[73] Assignee: The Furukawa Electric Co., Ltd., Japan

[21] Appl. No.: 365,472

[22] Filed: Dec. 27, 1994

[30] Foreign Application Priority Data

| | | | |
|---|---|---|---|
| Dec. 30, 1992 | [JP] | Japan | 5-352880 |
| Feb. 28, 1994 | [JP] | Japan | 6-029830 |
| Jul. 27, 1994 | [JP] | Japan | 6-175512 |

[51] Int. Cl.[6] ..... F28F 1/08; F28F 1/42

[52] U.S. Cl. ..... 165/177; 165/146; 165/179; 165/184; 138/38

[58] Field of Search ..... 165/177, 179, 165/183, 184, 146; 138/38; 29/890.053, 890.045, 890.05

[56] References Cited

U.S. PATENT DOCUMENTS

| | | | |
|---|---|---|---|
| 910,192 | 1/1909 | Grouvelle et al. | 138/38 |
| 1,713,020 | 5/1929 | Bowne | 138/38 |
| 2,080,626 | 5/1937 | Mojonnier | 138/38 |
| 2,122,504 | 7/1938 | Wilson | 165/184 |
| 2,663,321 | 12/1953 | Jantsch | 138/38 |
| 3,530,923 | 9/1970 | Mattern | 165/146 X |
| 3,724,523 | 4/1973 | Mattern | 165/177 X |
| 4,014,962 | 3/1977 | Del Notario | 165/177 X |

FOREIGN PATENT DOCUMENTS

| | | | |
|---|---|---|---|
| 273721 | 6/1913 | Germany | 165/177 |
| 3111575 | 10/1982 | Germany | 165/184 |
| 185094 | 9/1985 | Japan | 165/146 |
| 398154 | 12/1931 | United Kingdom | 165/177 |
| 566312 | 12/1944 | United Kingdom | 165/177 |
| 748030 | 4/1956 | United Kingdom | 165/146 |

*Primary Examiner*—Leonard R. Leo
*Attorney, Agent, or Firm*—Lorusso & Loud

[57] ABSTRACT

One heat transfer tube for an absorption refrigerating machine of the present invention has a plurality of grooves formed on the circumferential surface of a tube at uniformly angular intervals to extend continuously or discontinuously in the length direction of the tube, wherein the width and/or depth of each groove gently varies in the length direction of the groove, and the height of each ridge between the mutually adjacent grooves gently varies from the axial tube center in the length direction of the ridge. Another heat transfer tube of the present invention has a large number of concave portions formed in rows on the circumferential surface of the tube at predetermined angular intervals and each having a gently down-grade surface extending in the tube length direction to gradually get closer to the axial tube center and a gently up-grade surface extending continuously from the down-grade surface in the tube length direction to gradually become more distant from the axial tube center. Since the heat transfer tube has a plurality of grooves and ridges or concave portions formed on the circumference of the tube, the diffusion and interfacial turbulence of a medium can be substantially accelerated in both the axial and circumferential directions to display higher heat transfer performance.

6 Claims, 15 Drawing Sheets

HEAT TRANSFER TUBE FOR ABSORPTION REFRIGERATING MACHINE

BACKGROUND OF THE INVENTION

1. Field of the Invention

This invention relates to a heat transfer tube used for an absorber, a regenerator or an evaporator of an absorption refrigerating machine, and more particularly to a heat transfer tube having grooves or irregularities on the circumferential surface for use in an absorption refrigerating machine.

2. Description of the Prior Art

As shown in FIG. 19, an absorption refrigerating machine in general has an evaporator 4, an absorber 5, a regenerator 6 and a condenser 7.

In the evaporator 4 approximately under vacuum, heat transfer tubes 40 are arranged in a horizontal state at predetermined intervals in the vertical and horizontal directions, and the vertically adjacent heat transfer tubes 40 are communicated with each other.

A refrigerant (water) 44 supplied from the condenser 7 or a refrigerant pipe 41 having a refrigerant pump 42 is spread over the outside surface of the heat transfer tube 40 for the evaporator through a spreader pipe 43. Water flowing through the inside of the heat transfer tube 40 is cooled down by the refrigerant 44 flowing downwards along the surface of the heat transfer tube 40.

In the absorber 5 and the regenerator 6, heat transfer tubes 50, 60 are respectively arranged in a horizontal state at predetermined intervals in the vertical and horizontal directions, and the vertically adjacent heat transfer tubes 50, 60 are respectively communicated with each other.

An absorbent (aqueous solution of lithium bromide) is spread over the outside surface of the heat transfer tube 50 for the absorber through a spreader pipe 51. A refrigerant (water) flows through the inside of the heat transfer tube 50 and is supplied to a heat transfer tube 70 arranged in the condenser 7.

The refrigerant 44 is evaporated due to the temperature of water flowing through the inside of the heat transfer tube 40, and the resultant vapor of the refrigerant 44 is absorbed into a low-temperature absorbent 52 flowing downwards along the surface of the heat transfer tube 50 in the absorber 5. The absorbent 52 having the reduced concentration resulting from the absorption of the refrigerant vapor is sent to a spreader pipe 61 in the regenerator 6 using a pump 53.

The low-concentration absorbent 52 sent to the spreader pipe 61 is spread over the surface of the heat transfer tube 60 for the regenerator through the spreader pipe 61. While the absorbent 52 flows downwards along the surface of the heat transfer tube 60, the refrigerant absorbed into the absorbent 52 is boiled up by a heating medium flowing through the inside of the heat transfer tube 60, and as a result, separated from the absorbent 52.

The refrigerant vapor separated from the absorbent 52 by the regenerator 6 is cooled down for condensation through the heat transfer tube 70 in the condenser 7. The condensed refrigerant 44 is returned to the evaporator 4, and then spread over the heat transfer tube 40 through the spreader pipe 43.

On the other hand, the absorbent 52 regenerated by the regenerator 6 is cooled down by a heat exchanger 54, and subsequently returned to the absorber 5.

According to the circulation described above, water flowing through the inside of the heat transfer tube 40 of the evaporator 4 can be continuously cooled down.

Recently, with the demand of a smaller-sized and higher-performance absorption refrigerating machine, a smaller-diameter and higher-performance heat transfer tube has been required for the absorption refrigerating machine.

The heat transfer tubes used for the evaporator 4, the absorber 5 and the regenerator 6 are adapted for the transfer of heat between a fluid inside the heat transfer tube and a medium (the absorbent 52 or the refrigerant 44) flowing downwards along the surface of the heat transfer tube while keeping in contact with the same. Thus, in order to provide a smaller-sized heat transfer tube and to improve the heat transfer performance thereof, it is necessary to wet the surface of the heat transfer tube with the medium throughout as much as possible. Namely, it is necessary to accelerate the diffusion of the medium over the surface of the heat transfer tube and the expansion of the surface area of the heat transfer tube wet with the medium (or the improvement in wettability).

In addition, heat is transferred on the contact surface between the heat transfer tube and the medium in most cases. Thus, when the medium flows downwards along the surface of the heat transfer tube, it is necessary to further activate the convection of the medium (interfacial turbulence or disturbance of liquid membrane).

As for a heat transfer tube having a structure to accelerate the expansion of the surface area wet with a medium flowing along the circumferential surface and the disturbance of a liquid membrane, for example, Japanese Utility Model Laid-open No. 57-100161 (Invention by Masaki Minemoto) has disclosed a heat transfer tube for an absorber, in which a large number of small grooves are formed helically on the circumferential surface of the tube.

The heat transfer tube described in the above Publication is constituted to flow the absorbent along the helical grooves on the surface of the tube. Thus, the absorbent is substantially diffused in the axial direction (length direction) of the tube, and as a result, the wet area on the surface of the tube is expanded. In this manner, this heat transfer tube has been intended to improve the heat transfer performance and to provide a smaller-sized apparatus.

In addition, as for another heat transfer tube having a structure to accelerate the interfacial turbulence of a medium, for example, Japanese Patent Laid-open No. 63-6364 (Invention by Giichi Nagaoka and others) has disclosed a heat transfer tube for an absorber, in which a large number of projections each having a height of 2 mm are formed on the circumferential surface of a blank tube having an outer diameter of 19 mm in parallel to the tube axis, and each projection is notched at a depth of 0.5 mm at pitches of 5 mm.

The present inventors manufactured an experimental apparatus composed of a pair of supports capable of horizontally supporting five heat transfer tubes at intervals of 6 mm in the vertical direction, and a spreader pipe arranged to be spaced above by 25 mm from the uppermost heat transfer tube supported by the supports. In this case, a heat transfer tube manufactured on trial similarly to each of the prior art heat transfer tubes was used as each of five heat transfer tubes in the experimental apparatus. Then, the present inventors made observations of the flow state of red ink on the surface of the heat transfer tubes and the wet state of the heat transfer tubes, while continuously spreading the red ink through the spreader pipe.

As a result, in case of using the heat transfer tubes described in Japanese Utility Model Laid-open No. 57-100161, it was confirmed that the red ink flows in the axial direction (length direction) of the tube along the helical grooves due to the gravity in the range of each heat transfer tube from the top surface to the side surface, while the ink reaching to the side surface of the tube stops flowing along the helical grooves, and most ink drops across the ridges on both sides of each groove in the course of the process of flowing the ink downwards. Namely, a considerable surface area on the underside of the tube was not wet.

Further, the diffusion of the ink in the axial direction of the tube was inferior on the top surface of the tube as well.

On the other hand, in case of using the heat transfer tubes described in Japanese Patent Laid-open No. 63-6364, the ink was substantially diffused in the axial direction of the tube along the projections on the surface of the heat transfer tube. When the ink was collected between the mutually adjacent projections (grooves) up to the notches of the projections, the ink was moved from the notch portions of the projections to the next groove in the circumferential direction of the tube, and further diffused in the axial direction of the tube along the groove. Namely, the surface of the tube was satisfactorily wet as a whole.

However, in case of making the observations of the latter heat transfer tubes from a viewpoint of the interfacial turbulence, the liquid membrane was satisfactorily disturbed in the circumferential direction of the tube. On the other hand, since the shape of each groove between the mutually adjacent projections is uniform in the length direction, the liquid membrane was not satisfactorily disturbed in the axial direction of the tube.

SUMMARY OF THE INVENTION

It is an object of the present invention to provide a high-performance heat transfer tube for an absorption refrigerating machine, in which the above-mentioned problems can be solved, and the diffusion and the interfacial turbulence of a medium can be more satisfactorily accelerated not only in the axial direction but also in the circumferential direction of the tube, when the medium flows downwards along the surface of the tube due to the gravity.

In order to attain the above-mentioned object, in a first heat transfer tube for an absorption refrigerating machine as the present invention, a plurality of grooves extending continuously or discontinuously in the length direction of the tube are formed at predetermined angular intervals on the circumferential surface of the tube. The width of each groove varies gently in the length direction of the groove, and the height of each ridge between the mutually adjacent grooves varies from the axial center of the tube in the length direction of the ridge.

According to the first heat transfer tube, when the heat transfer tube is incorporated in an absorber, a regenerator or an evaporator to start an absorption refrigerating machine, a medium drops to a grooved portion on the upside of the heat transfer tube to be moved and diffused in the axial direction (length direction) of the tube along the grooves. Simultaneously, the liquid membrane of the medium moved in the axial direction of the tube is substantially disturbed, since the width of each groove varies gradually.

The medium moved in the axial direction of the tube with the interfacial turbulence flows to the next groove in the circumferential direction of the tube centering around the vicinity of a lower ridge portion. Accordingly, the medium is diffused in the circumferential direction, and simultaneously, the liquid membrane of the medium is disturbed when the medium gets over the ridges.

In this manner, the diffusion of the medium and the disturbance of the liquid membrane can be accelerated not only in the circumferential direction but also in the axial direction of the tube, and as a result, the heat transfer tube of the present invention can display a higher heat transfer performance.

The medium reaching to the underside of the heat transfer tube drops to the lower heat transfer tube.

In case that the groove width and the ridge height vary repeatedly at the approximately same pitch in the length direction of the tube, the diffusion of the medium and the disturbance of the liquid membrane can be easily uniformed in both the circumferential and axial directions of the tube at each of the groove and ridge portions of the heat transfer tube.

Thus, the heat transfer performance in the grooved portions can be averaged as a whole.

In the first heat transfer tube, each wide groove portion and each low ridge portion are preferably formed at the approximately same position on the circumference of the tube.

In this manner, when each wide groove portion and each low ridge portion are formed at the approximately same position on the circumference of the tube, the medium drops to the heat transfer tube and then flows from the narrow groove portions toward the wide groove portions to be diffused from the wide groove portions in the circumferential direction of the tube across the ridges.

In a second heat transfer tube for an absorption refrigerating machine according to the present invention, the grooves of the first heat transfer tube are modified such that the depth of each groove gently varies in the length direction of the groove.

According to the second heat transfer tube, the depth of each groove gently varies in the length direction of the groove. Thus, when the medium drops to the grooves of the heat transfer tube to be diffused in the axial direction of the tube, the medium flows from the shallow groove portions toward the deep groove portions on the upside of the heat transfer tube. On the other hand, the medium flows from the deep groove portions toward the shallow groove portions on the underside of the heat transfer tube.

Namely, certain directivity can be easily given to the medium diffused in the axial direction of the tube.

The bottom of each groove in the second heat transfer tube is preferably formed with a gently down-grade portion extending in the length direction of the groove to gradually get closer to the axial center of the tube, and a gently up-grade portion extending continuously from the gently down-grade portion to gradually become more distant from the axial center of the tube at the approximately same gradient as the gently down-grade portion.

With the constitution described above, a border portion between the gently down-grade portion and the gently up-grade portion of each groove constitutes the deepest portion of each groove.

Thus, the medium reaching to the grooves of the heat transfer tube flows toward each border portion on the upside of the heat transfer tube, while it flows so as to become more distant from each border portion on the underside of the heat transfer tube. In addition, since the gently down-grade portion and the gently up-grade portion are of the approximately same gradient, the medium can be easily diffused in the axial direction of the tube at uniform velocity.

Preferably, the peak (edge) portion of each ridge in the second heat transfer tube is repeatedly formed with a gently up-grade portion extending in the length direction of the ridge to gradually become more distant from the axial center of the tube, and a gently down-grade portion extending continuously from the gently up-grade portion to gradually get closer to the axial center of the tube at the approximately same interval and gradient as the gently up-grade portion. In the heat transfer tube, since the gently up-grade portion and the gently down-grade portion at the edge of each ridge are of the approximately same length and gradient, the medium in the groove flows into the next lower groove at the same pitch, and the medium can be uniformly diffused and disturbed in the circumferential direction of the tube with ease.

In the second heat transfer tube, as long as the deepest groove portion and the lower ridge portion on one or both sides of each groove are formed at the approximately same position on the circumference of the groove, the medium drops to the heat transfer tube to be moved from the deepest groove portion toward the next groove on the upside of the heat transfer tube.

In a third heat transfer tube for an absorption refrigerating machine of the present invention, a plurality of grooves extending continuously or discontinuously in the length direction of the tube are formed on the circumferential surface of the tube at predetermined angular intervals, and the width and depth of each groove vary gently in the length direction of the groove.

In the third heat transfer tube, each narrow groove portion and each deep groove portion are preferably formed at the approximately same position.

In the third heat transfer tube, when the heat transfer tube is incorporated in an absorber, a regenerator or an evaporator to start the absorption refrigerating machine, the medium drops to the grooved portions on the upside of the heat transfer tube and flows from the shallow groove portions toward the deep groove portions along the grooves to be moved and diffused in the axial direction (length direction) of the tube. Simultaneously, the interface of the medium is disturbed with the variation in width and depth of each groove.

The medium diffused in the axial direction of the tube with the interfacial turbulence flows soon into the next lower groove across the ridge to be diffused in the circumferential direction of the tube. When the medium gets over the ridges, the liquid membrane of the medium is disturbed.

On the underside of the heat transfer tube, the medium flows from the deep groove portions toward the shallow groove portions in the axial direction of the tube.

In this manner, the diffusion of the medium and the disturbance of the liquid membrane can be accelerated in both the axial and circumferential directions of the tube, and as a result, the heat transfer tube of the present invention can display higher heat transfer performance.

In case that the width and depth of each groove repeatedly vary at the approximately same pitch in the length direction of the tube, the diffusion of the medium and the disturbance of the liquid membrane can be easily uniformed in the axial direction of the tube at each of the groove and ridge portions of the heat transfer tube. Thus, the heat transfer performance in the groove portions can be averaged as a whole.

When a blank tube used to form each of the first to third heat transfer tubes of the present invention has an outer diameter of about 19.5 mm, each heat transfer tube is preferably designed such that the ratio of the width of the widest groove portion to that of the narrowest groove portion is set to be in the range of approximately 20 to 80 %.

In case that the minimum width of each groove is set to be too large for the maximum width, when the medium flows in the axial direction of the tube, the resistance is increased to obstruct the diffusion of the medium in the axial direction of the tube. On the other hand, in case that the minimum width of each groove is set to be too small for the maximum width, when the medium is moved and diffused in the axial direction of the tube, there is no possibility of any interfacial turbulence.

In each of the first to third heat transfer tubes of the present invention, the number of grooves is selected depending on the diameter of a blank tube to be used, and the size of the widest groove portion.

For instance, in case that the blank tube used to form a heat transfer tube has an outer diameter of about 19.5 mm, when the grooves are formed so as to be mutually adjacent to each other at uniformly angular intervals, the heat transfer tube is preferably designed such that the number of grooves is set to be about 3 to 12. Namely, when the grooves are formed too many, the average groove width is narrowed to obstruct the flow of the medium in the axial direction of the tube. On the other hand, when the grooves are formed too few, there is no possibility of accelerating the expansion of the wet surface area and the disturbance of the liquid membrane of the medium.

In each of the first to third heat transfer tubes, in case that the grooves are formed to have a torsional angle of not more than 35° in the axial direction of the tube, the diffusion of the medium and the disturbance of the liquid membrane are more satisfactorily accelerated.

However, when the torsional angle of the grooves in the axial direction of the tube exceeds 35°, there is a possibility of obstructing the diffusion of the medium in the axial direction of the tube.

In a fourth heat transfer tube of the present invention, the circumferential surface of the tube is formed with a large number of concave portions in a plurality of rows at predetermined angular intervals, and each concave portion has a gently down-grade surface extending in the length direction of the tube to gradually get closer to the axial center of the tube and a gently up-grade surface extending continuously from the gently down-grade surface in the length direction of the tube to gradually become more distant from the axial center of the tube.

In the fourth heat transfer tube, the mutual deepest portions of the adjacent rows of concave portions may be arranged alternately in the length direction of the tube, or formed at the approximately same position on the circumference of the tube.

In the fourth heat transfer tube, when this heat transfer tube is incorporated in an absorber, a regenerator or an evaporator to start the absorption refrigerating machine, the medium drops to the upside of the heat transfer tube and flows toward the deepest portion (border portion between the gently down-grade surface and the gently up-grade surface extending continuously from the gently down-grade surface) of each concave portion along the grade surface of each concave portion on the upside of the tube, and as a result, the medium is diffused in the axial direction of the tube, while the interface of the medium is disturbed.

The medium flowing along the gently grade surface of each concave portion gets soon out of each concave portion and flows downwards along the side portion of the tube to be diffused in the circumferential direction of the tube. When the medium is diffused in the circumferential direction of the tube to get out of the concave portion, the liquid membrane of the medium is disturbed.

Further, the medium reaching to the underside of the tube flows to become more distant from the deepest portion of each concave portion along the gently grade surface of each concave portion on the underside of the tube. Thus, the medium is diffused in the axial direction of the tube, while the liquid membrane is disturbed. Then, the medium drops downwards from the tube.

In the fourth heat transfer tube, the gradient angle of each of the gently up-grade surface and the gently down-grade surface of each concave portion is preferably set to be in the range of 0.5 to 7°.

When the gradient angle is less than 0.5°, the medium is hardly diffused in the axial direction of the tube. On the other hand, when the gradient angle exceeds 7°, the flow velocity of the medium is increased in the axial direction of the tube to hardly disturb the liquid membrane.

Preferably, in the fourth heat transfer tube, the gently down-grade surface and the gently up-grade surface of each concave portion are formed symmetrically, or the concave portions are formed at the approximately same pitch in the length direction of the tube, since the flow of the medium and the disturbance of the liquid membrane are substantially uniformed in both the axial and circumferential directions of the tube.

In the fourth heat transfer tube, in case that the rows of the concave portions are formed to have a torsional angle of not more than 35° in the axial direction of the tube, the diffusion of the medium and the disturbance of the liquid membrane can be more satisfactorily accelerated. However, when the torsional angle of the grooves in the axial direction of the tube exceeds 35°, there is a possibility of obstructing the diffusion of the medium in the axial direction of the tube.

BRIEF DESCRIPTION OF THE DRAWINGS

The foregoing and other objects and features of the present invention will become apparent from the following description of preferred embodiments of the invention with reference to the accompanying drawings, in which.

DETAILED DESCRIPTION OF THE PREFERRED EMBODIMENTS

Figure 1:
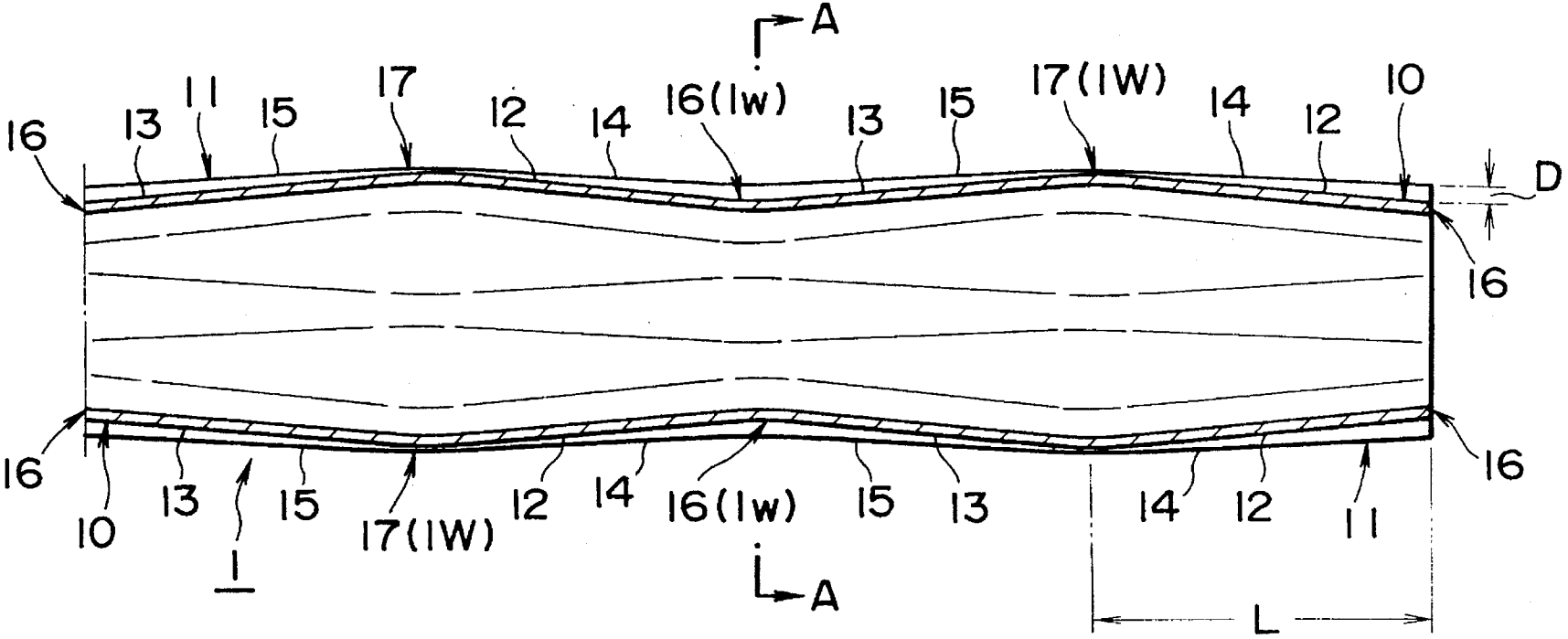
FIG. 1 is a partially sectional view showing a heat transfer tube for an absorption refrigerating machine as an embodiment of the present invention.

A blank tube made of phosphor deoxidized copper and having an outer diameter of 19.05 mm and a thickness of 0.6 mm is worked using a working apparatus shown in FIG. 5, which will be described later, to provide a heat transfer tube 1 for an absorption refrigerating machine as shown in FIG. 1. Six grooves 10 extending continuously in the length direction are formed at uniformly angular intervals on the circumferential surface of the heat transfer tube 1.

Figure 2:
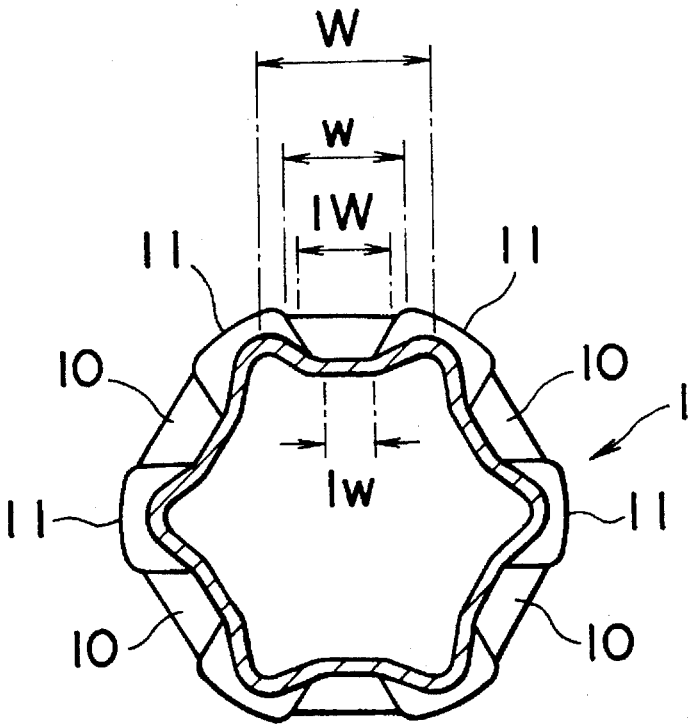
FIG. 2 is an enlarged-scale sectional view taken along a line A—A indicated by an arrow in the heat transfer tube shown in FIG. 1.

As shown in FIGS. 1 and 2, each groove 10 has a wide portion W and a narrow portion w which are repeatedly formed in an alternate manner at the pitch of a length L (approximately 20 mm). Thus, the width of each groove 10 varies gently in the length direction with the wide and narrow portions. The wide portion W and the narrow portion w of each groove 10 are respectively formed at a narrowest bottom portion 1*w* (approximately 2 mm) and a widest bottom portion 1W (approximately 4 mm).

As shown in FIG. 1, an edge (peak) portion of each ridge 11 between the mutually adjacent grooves 10 has a gently up-grade portion 15 having the above-mentioned length of L and extending in the length direction of the ridge to gradually become more distant from the axial center of the tube, and a gently down-grade portion 14 extending continuously from the gently up-grade portion 15 to gradually get closer to the axial center of the tube at the approximately same interval and gradient as the gently up-grade portion 15.

Thus, the height of each ridge 11 varies gently from the axial center of the tube in the length direction of the ridge 11 with the repeatedly formed grade portions 14, 15 respectively having the length of L.

The difference in height between a higher portion and a lower portion of each ridge 11 is designed to be approximately equal to 0.8 mm on average.

The bottom of each groove 10 has a gently down-grade portion 12 having the length of L and extending in the length direction of the groove 10 to gradually get closer to the axial center of the tube and a gently up-grade portion 13 extending continuously from the gently down-grade portion 12 to gradually become more distant from the axial center of the tube at the approximately same interval and gradient as the gently up-grade portion 12.

Thus, the depth of each groove 10 gently varies in the length direction of the groove 10 with the repeatedly formed grade portions 12, 13 respectively having the length of L.

In each groove 10 of this embodiment, the depth D (from the edge of each ridge 11 to the bottom of each groove) of the deepest portion 16 is 1.6 mm on average, and the depth of the shallowest portion 17 is 0.1 mm on average.

The deepest portion 16 of each groove 10, the narrowest bottom portion 1*w* and the lowest portion of each ridge 11, as well as the shallowest portion 17 of each groove 10, the widest bottom portion 1W and the highest portion of each ridge 11 are located at the approximately same circumferential direction of the tube 1, respectively.

In this embodiment, the diameter of a circle defined by connecting the peaks of the highest portions of the ridges 11 is set to be smaller by about 1 to 2 mm than the diameter of the blank tube.

According to the heat transfer tube 1 of the embodiment, when the heat transfer tube 1 is incorporated in an absorption refrigerating machine for the use, for example, an absorbent is spread over or drops to the heat transfer tube 1 and flows to be diffused along the grooves 10 toward the down-grade portions of the grooves 10 on the upside of the heat transfer tube 1 in the state shown in FIG. 1. Then, the absorbent is collected around each deepest portion 16. In this manner, when the absorbent flows along the grooves 10 toward the down-grade portions, the liquid membrane of the absorbent is substantially disturbed, since each groove 10 gently varies in width and depth.

In addition, since the gently down-grade portion 12 and the gently up-grade portion 13 of each groove 10 are of the approximately same gradient and length, the diffusion of the absorbent and the disturbance of the liquid membrane are easily uniformed in the axial direction of the tube.

When the absorbent is collected in each deepest portion 16 in some degree on the upside of the heat transfer tube 1, the absorbent flows from the portion centering around the lowest position of each ridge 11 downwards along the circumference of the tube, and subsequently flows into the lower groove 10. While the absorbent flows to be diffused toward the down-grade portion of the lower groove 10, the absorbent mainly flows from the portion centering around the lowest portion of the next ridge 11 on the lower side of the lower groove 10 toward the further next lower groove 10.

In this manner, when the absorbent flows (is diffused) in the circumferential direction of the tube across the ridges 11, the liquid membrane of the absorbent can be substantially disturbed.

Further, since the ridges 11 are of the approximately same length from the lower position to the higher position, and the grade portions 14, 15 at the edge of each ridge 11 are of the approximately same gradient, the diffusion of the absorbent and the disturbance of the liquid membrane can be easily uniformed in the circumferential direction of the tube.

In reverse gradient portions of each groove 10 on the underside of the tube 1, the absorbent flows from the deepest portion 16 toward the shallowest portion 17 in each groove 10 and drops downwards.

According to the heat transfer tube 1 in this embodiment described above, the absorbent is substantially diffused not only along the gradient of each groove 10 in the axial direction of the tube, but also along the port,ion centering around the lowest position of each ridge in the circumferential direction of the tube. As a result, the wet surface area of the heat transfer tube 1 can be further expanded. In addition, since the width of each groove 10 and the height of each ridge 11 vary in the length direction, the disturbance of the liquid membrane can be accelerated in both the axial and circumferential directions of the tube.

Accordingly, even a small-diameter heat transfer tube can display the highly heat transfer performance and makes contribution toward providing a small-sized absorber, regenerator or evaporator of an absorption refrigerating machine.

In the heat transfer tube of the embodiment shown in FIG. 1, the deepest portion 16 of each groove 10, the narrowest bottom portion 1*w* of the bottom of the groove and the lowest portion of each ridge 11, as well as the shallowest portion 17 of each groove 10, the widest bottom portion 1W and the highest portion of each ridge 11 are formed so as to be located in the approximately same circumferential direction of the tube 1. Otherwise, these portions may be located to be offset from one another, or the mutual deepest portions 16, as well as the mutual shallowest portions 17 of the mutually adjacent grooves 10 may be located to be offset from one another.

Figure 8:
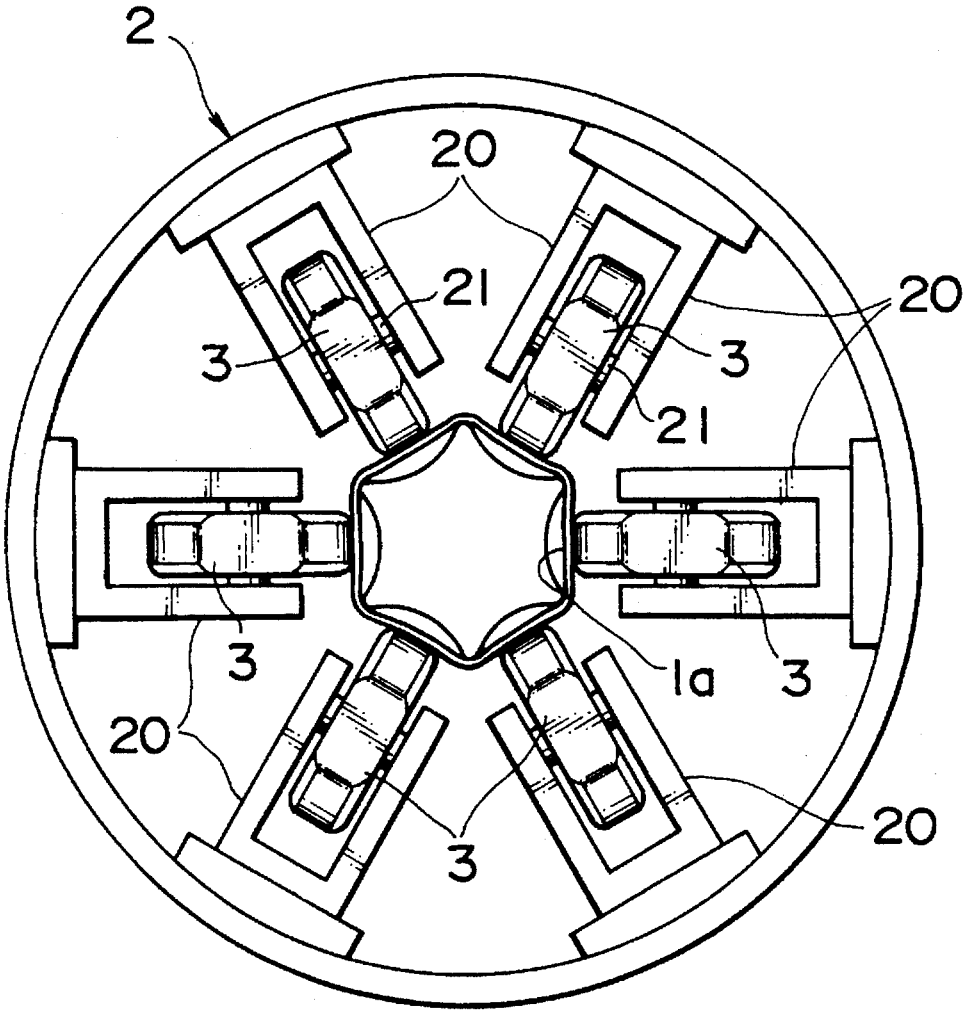
FIG. 8 is a schematic front view showing a heat transfer tube manufacturing apparatus using the working roll shown in FIGS. 6 and 7.

The heat transfer tube 1 of the embodiment described above is manufactured industrially by a working apparatus (dice) shown in FIG. 8.

Figure 6:
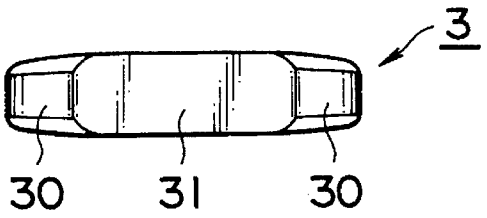
FIG. 6 is a plan view showing a working roll as an embodiment for manufacturing the heat transfer tube shown in FIG. 1.
Figure 7:
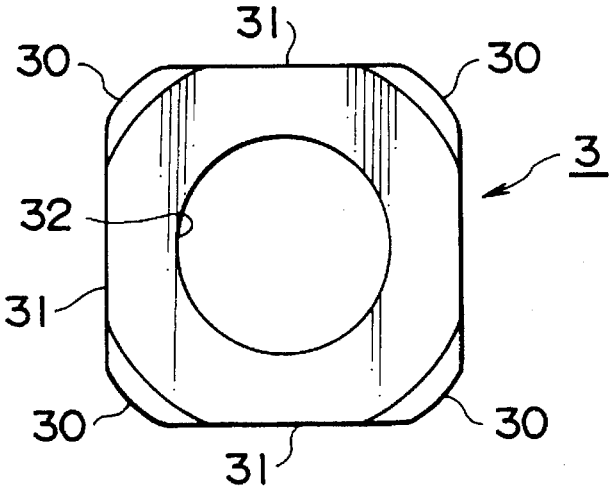
FIG. 7 is a front view showing the working roll shown in FIG. 6.

The working apparatus shown in FIG. 8 has a cylindrical or polygonal head 2. Six pieces of approximately U-shaped support frames 20 are fixed to the inside of the head 2 such that the frames mutually face to a center portion and are arranged at uniformly angular intervals, and an equal-sized working roll 3 structured as shown in FIGS. 6 and 7 is rotatably supported to each support frame 20 through a shaft. The space between the mutually facing working rolls 3 is set to be approximately equal to the sectional size of the heat transfer tube 1 of the embodiment described above.

A square metal plate having a pitch diameter of 50 mm and a thickness of 4 mm is worked to provide each working roll 3 having an axial hole 32 formed in the center of the metal plate, a chamfer portion 30 formed by chamfering each of four corners of the metal plate in the R-shape, and a flat portion 31 formed by cutting both sides of the chamber portion 30 to a width of about 2 mm so as to extend continuously between the mutually adjacent chamfer portions 30.

A blank tube 1*a* is guided into the space defined by 6 pieces of mutually facing working rolls 3 of the working apparatus shown in FIG. 8. Then, when the blank tube 1*a* is drawn out in a certain direction, each working roll 3 is brought into contact with the blank tube 1*a* to rotate each working roll 3. By so doing, the grooves 10 and the ridges 11 are formed on the circumferential surface of the blank tube 1*a*, and as a result, the heat transfer tube 1 shown in FIG. 1 is continuously formed.

A portion of the blank tube 1*a* pressed by the chamfer portion 30 of each working roll 3 is formed into the deepest portion 16 of each groove 10 in the heat transfer tube 1 shown in FIG. 1, and an approximately center portion of the blank tube pressed by the flat portion 31 is formed into the shallowest portion 17 of each groove 10.

When the similar portions of the respective working rolls 3 are pressed against the blank tube 1*a* toward the axial center to draw out the blank tube 1*a*, the heat transfer tube 1 approximately as shown in FIG. 1 can be formed. On the other hand, when the different portions of the respective working rolls 3 are pressed against the blank tube 1*a* toward the axial center to draw out the blank tube, the heat transfer tube is formed such that the grooves and ridges are offset from one another in planar shape.

In the heat transfer tube 1 shown in FIG. 1, the height of each ridge 11 varies in the length direction. On the other hand, when the width of a contact portion (circumferential portion) between each working roll 3 and the blank tube 1*a* in the working apparatus shown in FIG. 8 is set to be smaller as a whole, any high and low ridge portions are not formed on the ridge 11. In this manner, even though each ridge 11 has no difference of altitude, the heat transfer tube of the embodiment can carry out the following operation.

In this case, when the absorbent drops to the upside of the heat transfer tube 1, the absorbent is moved and diffused from the shallow portions toward the deeper portions (in the axial direction of the tube) along the grooves 10, while the liquid membrane of the absorbent is disturbed in the circumferential direction of the tube with the variation of the groove bottom width.

When the absorbent diffused in the axial direction of the tube with the interfacial turbulence is collected up to a predetermined amount, the collected absorbent flows to the next groove 10 in the circumferential direction of the tube across the ridge 11. As a result, the absorbent is diffused in the circumferential direction, and the liquid membrane is disturbed when the absorbent gets over the ridges 11.

On the underside of the heat transfer tube 1, the absorbent is diffused from the deep portions toward the shallower portions along the grooves 10.

Figure 3:
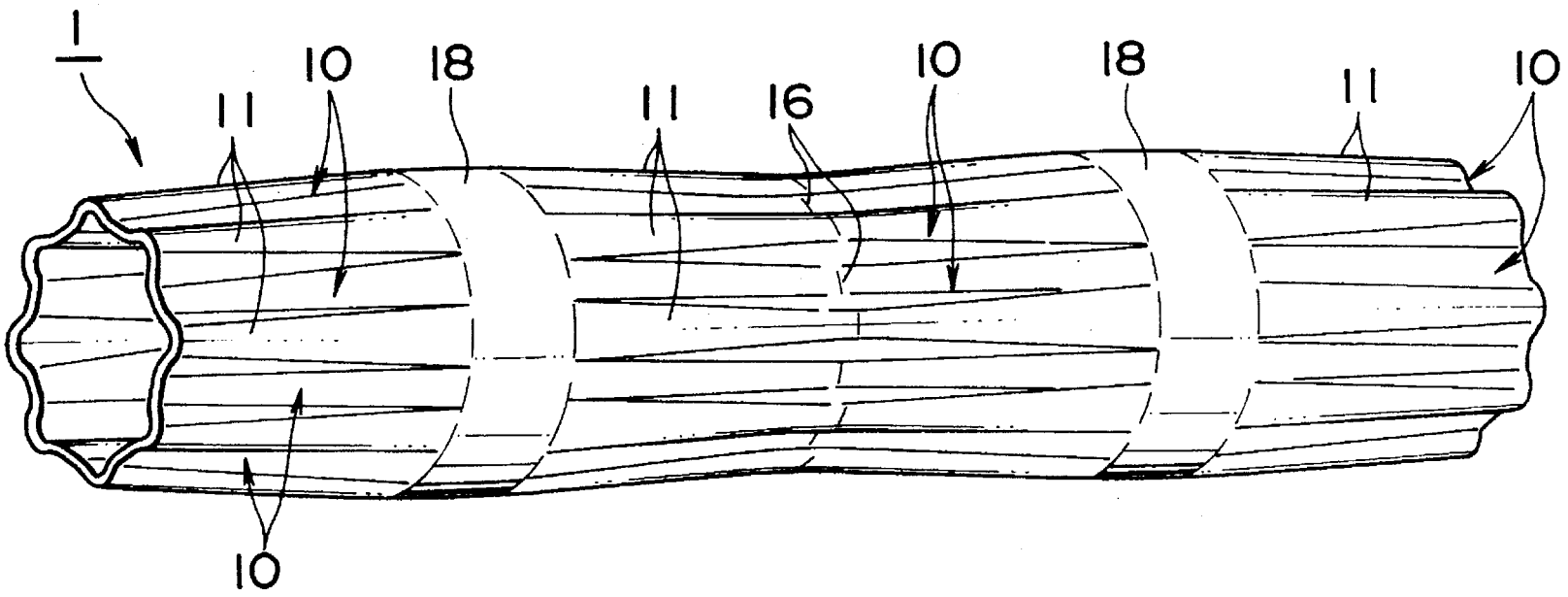
FIG. 3 is a partially perspective view showing a heat transfer tube as another embodiment of the present invention.

FIG. 3 shows a heat transfer tube as another embodiment of the present invention.

The heat transfer tube 1 in the embodiment shown in FIG. 3 has eight grooves 10 extending discontinuously in the length direction of the tube at uniformly angular intervals on the circumferential surface of the tube, and a cylindrical pipe portion 18 is provided between the mutually adjacent grooves 10 in the length direction.

The heat transfer tube shown in FIG. 3 is approximately similar in other constitution and function to the heat transfer tube shown in FIG. 1, except that a portion of the cylindrical pipe portion 18 is operated approximately similarly to a normal flat pipe. Thus, the detailed description thereof will be omitted.

The heat transfer tube 1 shown in FIG. 3 can be manufactured by a modified working apparatus, in which the center of each flat portion 31 of the working roll 3 shown in FIGS. 6 to 8 is notched by a predetermined range.

Figure 4:
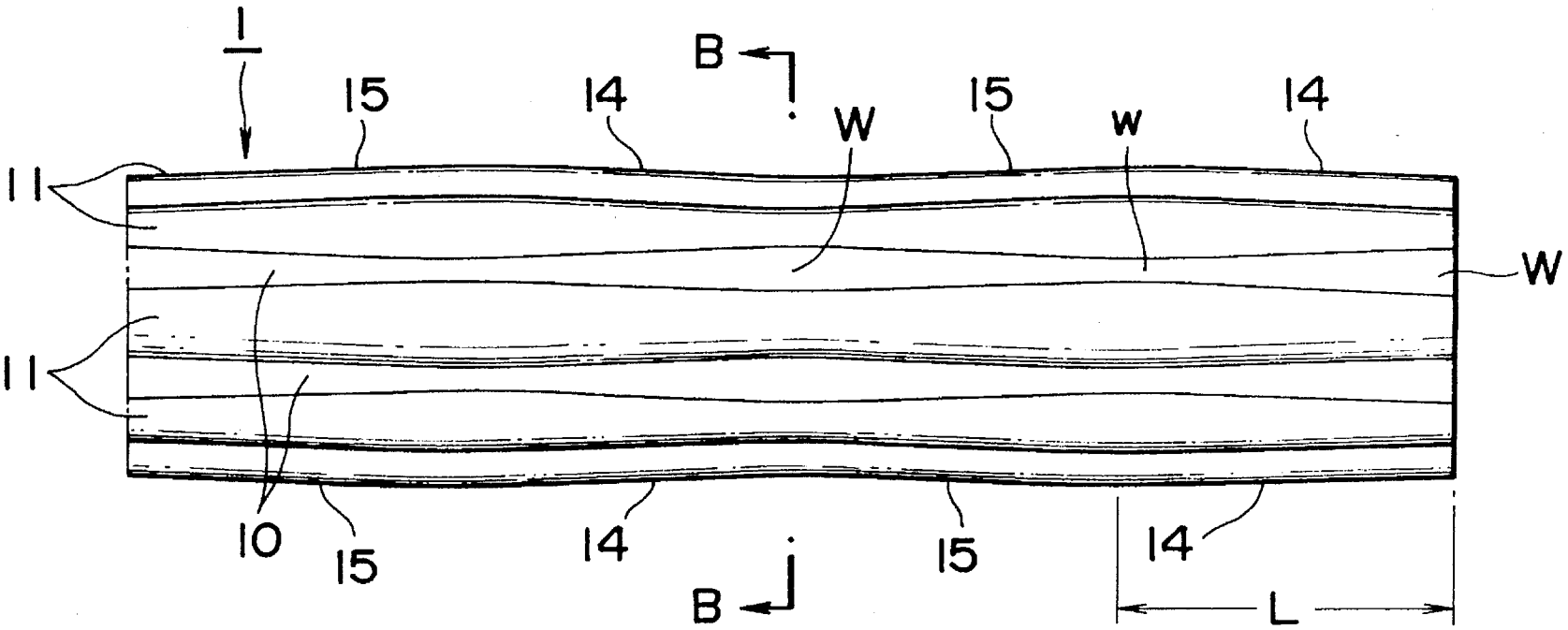
FIG. 4 is a partially plan view showing a heat transfer tube as a further embodiment of the present invention.
Figure 5:
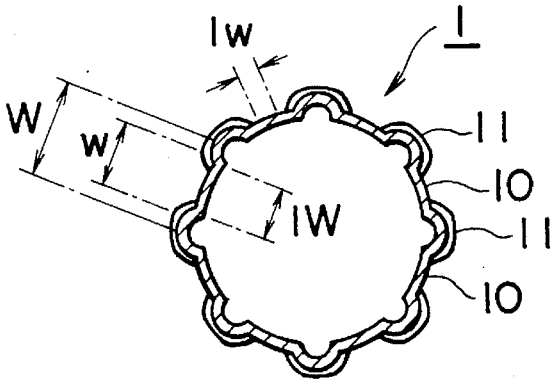
FIG. 5 is a sectional view taken along a line B—B indicated by an arrow in the heat transfer tube shown in FIG. 4.

FIGS. 4 and 5 show a heat transfer tube as a further embodiment of the present invention, respectively.

The heat transfer tube in the embodiment has eight grooves 10 extending continuously in the length direction of the tube 1. Each groove 10 is of the approximately same length of L from a wide portion W to a narrow portion w of each groove 10. The wide portion W and the narrow portion w are repeatedly formed in an alternate manner at the pitch of the length of L, and as a result, the bottom width of each groove 10 gently varies in the length direction.

In this embodiment, the wide portion W and the widest bottom portion 1W, as well as the narrow portion w and the narrowest bottom portion 1*w* are respectively located at the same position, and any gently grade portions 12, 13 in the embodiment shown in FIG. 1 are not formed on the bottom of each groove 10.

The highest portion and the lowest portion of each ridge 11 between the mutually adjacent grooves 10 are respectively located at the narrow portion w and the wide portion W of each groove 10.

According to the heat transfer tube 1 shown in FIG. 4, in case that this heat transfer tube 1 is incorporated in an absorber of an absorption refrigerating machine for the use, for example, when the absorbent drops to the upside of the heat transfer tube, the absorbent is moved and diffused in the axial direction of the tube along the grooves 10, while the liquid membrane of the absorbent is disturbed in the axial direction of the tube with the variation of the bottom width of each groove 10.

The absorbent diffused in the axial direction of the tube with the interfacial turbulence flows to the next groove in the circumferential direction of the tube centering around the vicinity of the lower portion of each ridge 11 and is diffused in the circumferential direction. The liquid membrane of the absorbent is disturbed in the circumferential direction when the absorbent gets over the ridges 11.

On the underside of the heat transfer tube 1, the absorbent is diffused from the narrow portion w toward the wide portion W in most cases and thereafter drops downwards.

In this manner, the diffusion of the absorbent and the disturbance of the liquid membrane can be accelerated not only in the circumferential direction but also in the axial direction of the tube. As a result, the heat transfer tube can display a higher heat transfer performance.

The heat transfer tube shown in FIGS. 4 and 5 can be industrially manufactured by a modified working apparatus, in which eight pieces of circular working rolls 3 are used instead of the working rolls 3 in the working apparatus shown in FIG. 8, and the width of the surface of each working roll 3 for applying pressure to the blank tube is varied at the predetermined pitch in the circumferential direction.

The heat transfer tube 1 in the embodiment shown in FIGS. 3, 4 can be put into practical use, even though the mutual wide and narrow portions W, w of the mutually adjacent grooves 10 are located to be offset from each other. In this case, the circumferential positions of the mutually adjacent grooves 10 in the heat transfer tube shown in FIG. 3 are offset from each other.

Figure 9:
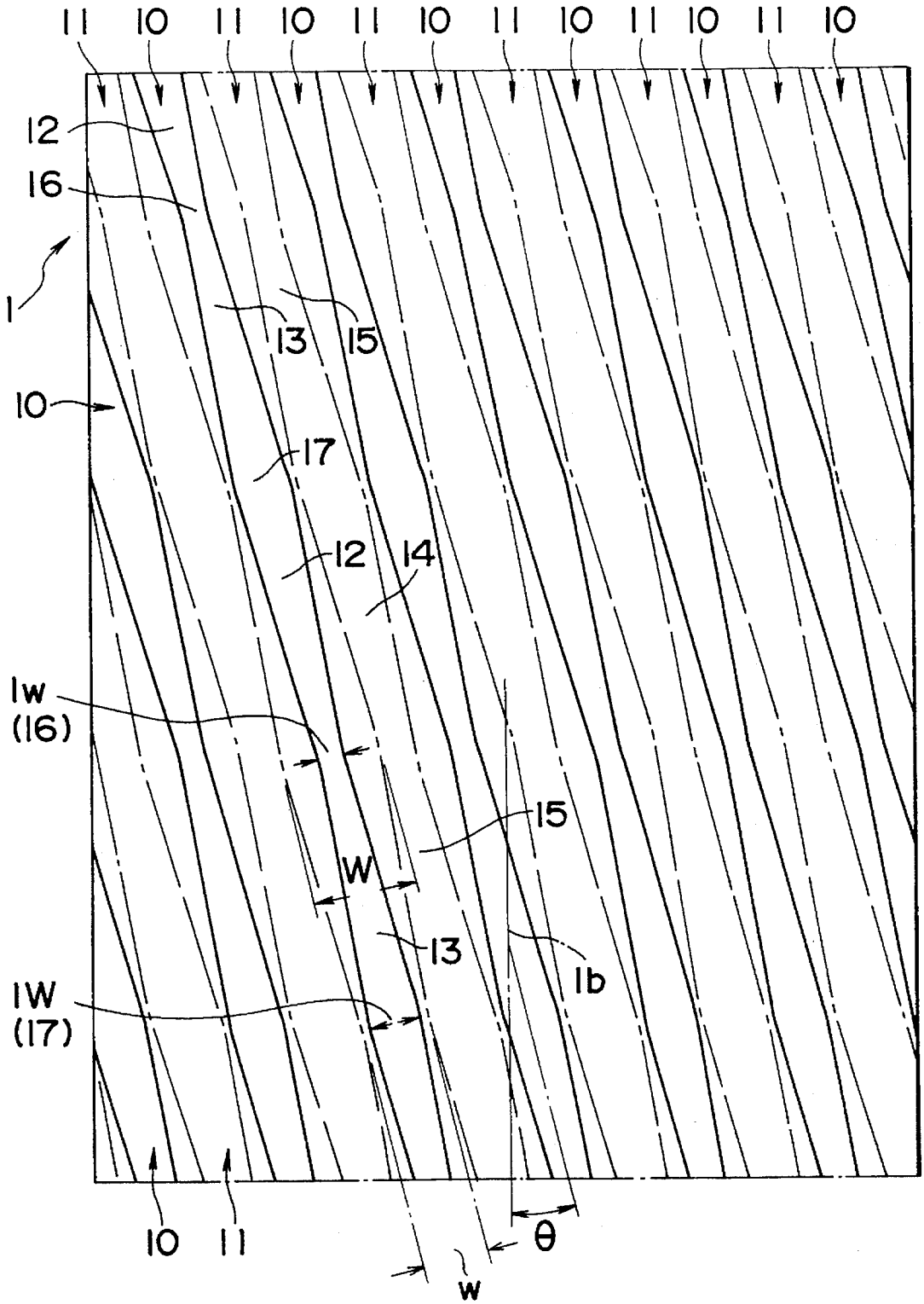
FIG. 9 is a partially development plan view showing a heat transfer tube for an absorption refrigerating machine as a further embodiment of the present invention.

FIG. 9 shows a heat transfer tube as a still further embodiment of the present invention.

The constitution of the heat transfer tube 1 in this embodiment is approximately similar to the heat transfer tube shown in FIG. 1, except that each groove on the surface of the tube is formed to have a torsional angle θ of about 14° in the direction of a tube axis 1*b*.

Figure 10:
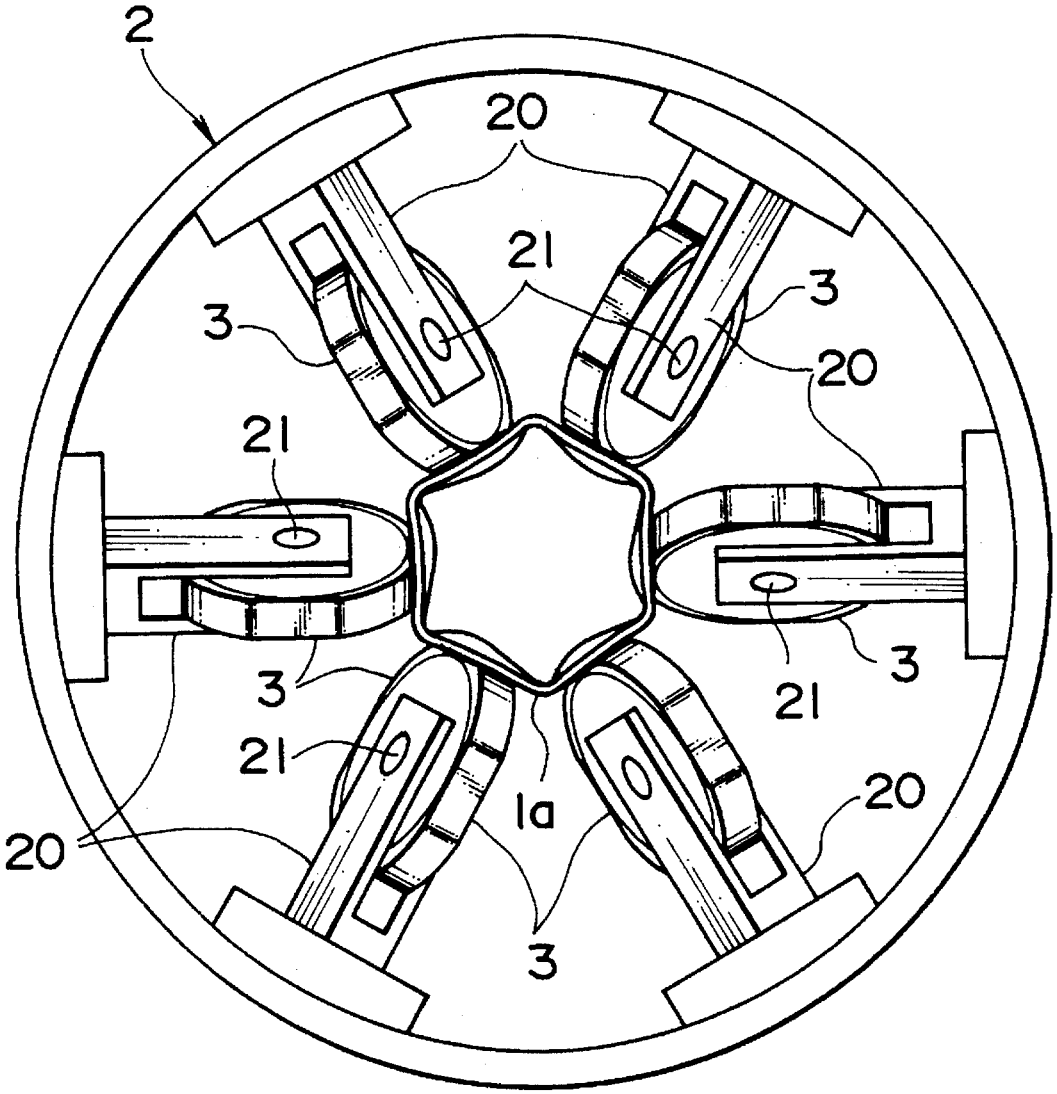
FIG. 10 is a schematic front view showing a working apparatus as an embodiment for manufacturing the heat transfer tube shown in FIG. 9.

The heat transfer tube 1 shown in FIG. 9 is manufactured by inserting a blank tube 1*a* into the space defined by the working rolls 3 which are respectively shifted from the positions shown in FIG. 8 so as to have a crossing angle of about 14° in the axial direction of the blank tube 1*a* as shown in FIG. 10.

The advantage of the heat transfer tube shown in FIG. 9 is that the diffusion of the absorbent and the disturbance of the liquid membrane in both the axial and circumferential directions of the tube can be accelerated more than those of the heat transfer tube shown in FIG. 1.

The torsional angle θ described above is preferably set to be not more than 35° from the viewpoint of performance. Namely, when the torsional angle θ exceeds 35°, there is a possibility of obstructing the diffusion of the absorbent.

With respect to the heat transfer tube shown in FIGS. 3 and 4, as long as each groove 10 is formed so as to have a predetermined torsional angle in the axial direction of the tube similarly to each groove 10 of the heat transfer tube 1 shown in FIG. 9, it is also possible to further accelerate the disturbance of the liquid membrane and the diffusion of the absorbent flowing downwards along the surface of the grooves.

In the heat transfer tube 1 in each of the embodiments described above, while the inner bottom surface of each groove 10 is formed as a flat surface, a circular arc shape in section may be adapted for the inner bottom portion of each groove 10.

Further, in the heat transfer tube of the embodiments described above, each groove 10 takes an approximately drum-like planar shape as viewed centering around the narrow portion. Otherwise, as long as the width of each groove varies gently in the length direction, each groove may take any different planar shape other than the drum-like shape.

The planar shape of each groove can be arbitrarily selected depending on the variation of the shape of the contact portion between each working roll 3 shown in FIG. 8 and the blank tube 1*a*.

In each of the embodiments described above, the more the grooves 10 are formed on the tube 1, the narrower the groove width is, and as a result, the flow of the liquid membrane is obstructed in the axial direction of the tube. On the other hand, when the grooves 10 are formed too few, there is no possibility of accelerating the expansion of the wet surface area and the interfacial turbulence.

When the outer diameter of the blank tube is or approximates to 19.5 mm as described above, the number of grooves is preferably designed in the range of about 3 to 12 as standards.

Further, when the difference in width between the widest bottom portion 1W and the narrowest bottom portion 1*w* in each groove 10 is too large, the resistance of a fluid is increased to obstruct the movement of the absorbent in the axial direction of the tube. On the other hand, when the difference is too small, the interfacial turbulence in the axial direction of the tube cannot be expected at the time of moving the absorbent. Therefore, when the outer diameter of the blank tube is about 19.5 mm, the ratio of the width of the narrowest bottom portion 1*w* to that of the narrowest bottom portion 1W in each groove 10 is preferably set to be in the range of 20 to 80 %.

Figure 11:
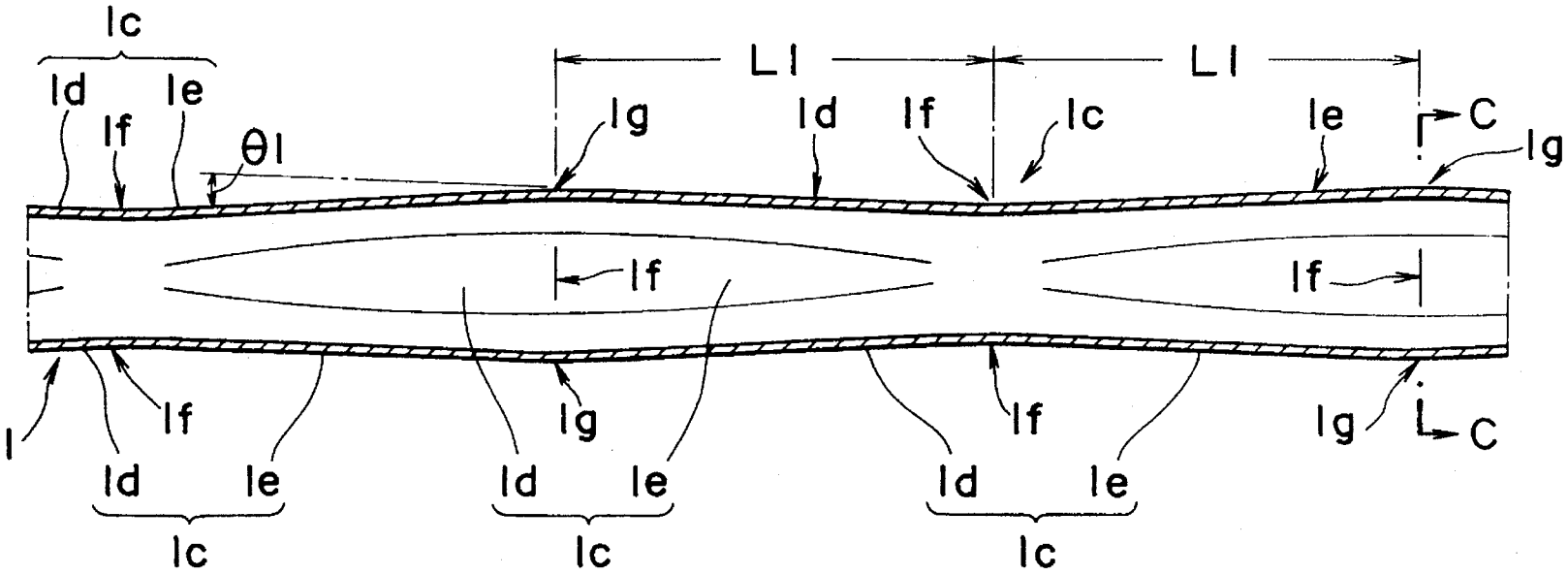
FIG. 11 is a partially sectional view showing a heat transfer tube as a still further embodiment of the present invention.
Figure 12:
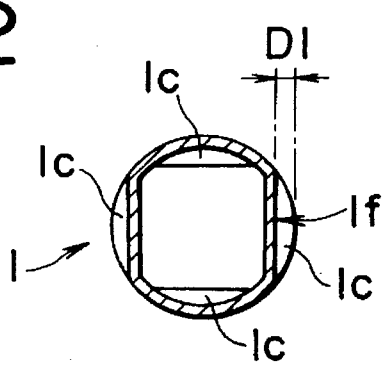
FIG. 12 is a sectional view taken along a line C—C indicated by an arrow in the heat transfer tube shown in FIG. 11.

FIGS. 11 and 12 show a heat transfer tube as a yet further embodiment of the present invention.

The heat transfer tube shown in FIG. 11 is made of phosphor deoxidized copper and has the maximum outer diameter of 19.05 mm and a thickness of 0.6 mm. The surface of the heat transfer tube 1 is formed with a large number of concave portions 1*c* each having a gently down-grade surface 1*d* extending in the length direction to gradually get closer to the axial center of the tube 1, and a gently up-grade surface 1*e* extending continuously from the gently down-grade surface 1*d* to gradually become more distant from the axial center of the tube 1.

The concave portions 1*c* are formed in four rows at angular intervals of about 90° in the length direction of the heat transfer tube 1. The upper and lower rows of the concave portions 1*c* and the left and right side rows of the concave portions 1*c* are formed to be alternately located in the length direction of the tube 1, without being located in the same circumferential direction of the tube.

The length L1 of each of the gently down-grade surface 1*d* and the gently up-grade surface 1*e* of each concave portion 1*c* is 75 mm, the depth D1 of the deepest portion 1*f* of each concave portion 1*c* is 3 mm, the gradient angle θ 1 of each of the grade surfaces 1*d*, 1*e* is about 1.5°, and the interval from the peak 1*g* between the mutually adjacent concave portions 1*c*, 1*c* to the next peak 1*g* is 150 mm.

According to the heat transfer tube 1 in the embodiment shown in FIG. 11, in case that the heat transfer tube 1 is incorporated in an absorber of an absorption refrigerating machine for the use, for example, when the absorbent is spread from above or drops, the absorbent is easily diffused in the axial direction of the tube along the grade surfaces 1*d*, 1*e*, and the liquid membrane is also easily disturbed along the grade surfaces 1*d*, 1*e*.

Further, when the absorbent is diffused in the circumferential direction of the tube due to the variation of the width of each of the grade surfaces 1*d*, 1*e* in the length direction, the liquid membrane is substantially disturbed.

In this manner, since the diffusion of the absorbent and the disturbance of the liquid membrane can be accelerated in both the axial and circumferential directions of the tube, it is possible to obtain a heat transfer tube having a high heat transfer performance.

According to the experiment, it is found that the gradient angle θ 1 of each of the grade surfaces 1*d*, 1*e* is preferably set to be in the range of about 0.5 to 7°, and the concave portions 1*c* are preferably formed in about three to eight rows.

When the angle θ 1 of each of the grade surfaces 1*d*, 1*e* is smaller than the above-mentioned value, the medium hardly flows in the axial direction of the tube. On the other hand, when the angle θ 1 is larger than the above-mentioned value, the flow velocity of the medium is increased to hardly disturb the liquid membrane.

Figure 15:
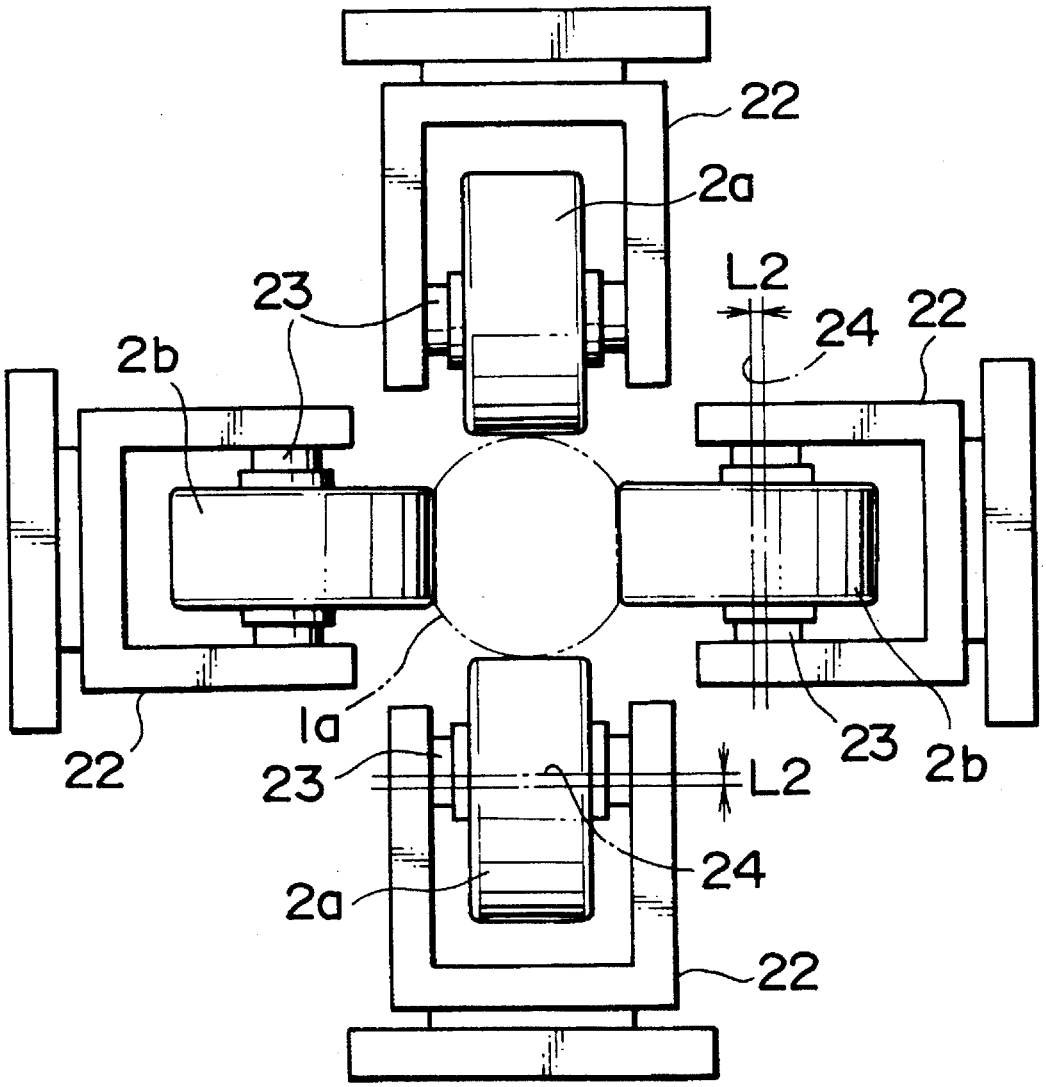
FIG. 15 is a schematic front view showing a working apparatus as an embodiment for manufacturing the heat transfer tube shown in FIG. 11.

The heat transfer tube in the embodiment shown in FIG. 11 is manufactured industrially by a working apparatus as shown in FIG. 15, for instance.

The working apparatus shown in FIG. 15 has four frames 22 arranged to mutually face to a center portion at angular intervals of approximately 90°, and working rolls 2*a*, 2*a*, 2*b*, 2*b* are rotatably supported to the frames.

Then, a shaft 23 of each of the rolls 2*a*, 2*b* is eccentric by a predetermined distance L2 (approximately 2 mm in this embodiment) from the center 24 of each of the rolls 2*a*, 2*b*. The heat transfer tube 1 shown in FIG. 11 is manufactured by inserting a blank tube 1*a* into the space defined by the rolls 2*a*, 2*a*, 2*b*, 2*b* such that when the rolls 2*b* on the left and right sides in FIG. 15 are respectively projected in the opposite direction due to the eccentricity, the upper and lower rolls 2*a* are retreated in the opposite direction.

Figure 13:
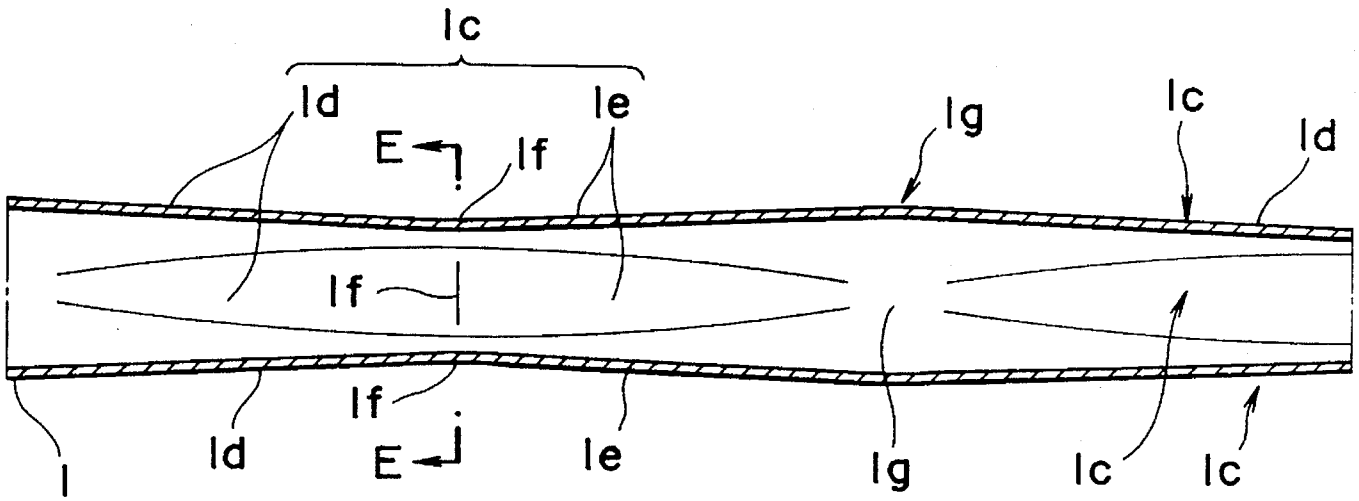
FIG. 13 is a partially sectional view showing a heat transfer tube as a yet further embodiment of the present invention.
Figure 14:
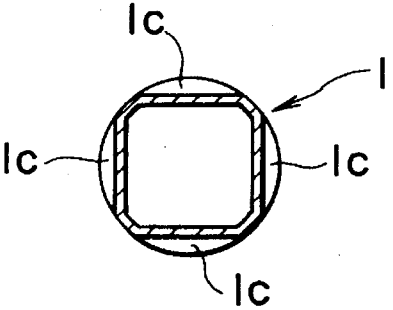
FIG. 14 is a sectional view taken along a line E—E indicated by an arrow in the heat transfer tube shown in FIG. 13.

In the heat transfer tube 1 in the embodiment shown in FIG. 11, while the upper and lower rows of the concave portions 1*c* and the left and right rows of the concave portions 1*c* are arranged in an alternate manner, these concave portions may be constituted such as to be located at the same positions in the circumferential direction of the heat transfer tube 1, as shown in FIGS. 13 and 14.

The heat transfer tube 1 shown in FIGS. 13 and 14 is also manufactured industrially by the working apparatus shown in FIG. 15. In this case, the rolls 2*a*, 2*a* and 2*b*, 2*b* are arranged so as to be synchronously projected or retreated in the opposite direction in the course of rotation, and a blank tube 1*a* is inserted into the space defined by the rolls 2*a*, 2*a*, 2*b*, 2*b*.

The heat transfer tube 1 in the embodiment shown in FIG. 11 can be put into practical use, even though each row of the concave portions 1*c* is arranged to be offset from each other little by little in the length direction of the heat transfer tube 1.

Further, each of the gently down-grade surface 1*d* and the gently up-grade surface 1*e* can be formed with a large number of small grooves (not shown) in parallel in the length direction of the grade surfaces. In this case, the absorbent flows more easily along the grade surfaces 1*d*, 1*e* due to such a large number of small grooves. Also, in the concave portion 1*c* located on the side of the heat transfer tube 1 when arranged, the absorbent easily flows toward the deepest portion 1*f* of the concave portion 1*c*. The heat transfer tube having such small grooves can be manufactured by a modified working apparatus, in which the surface of each working roll 2*a*, 2*b* of the working apparatus shown in FIG. 15 is provided with stripe-like knurls (not shown).

Figure 16:
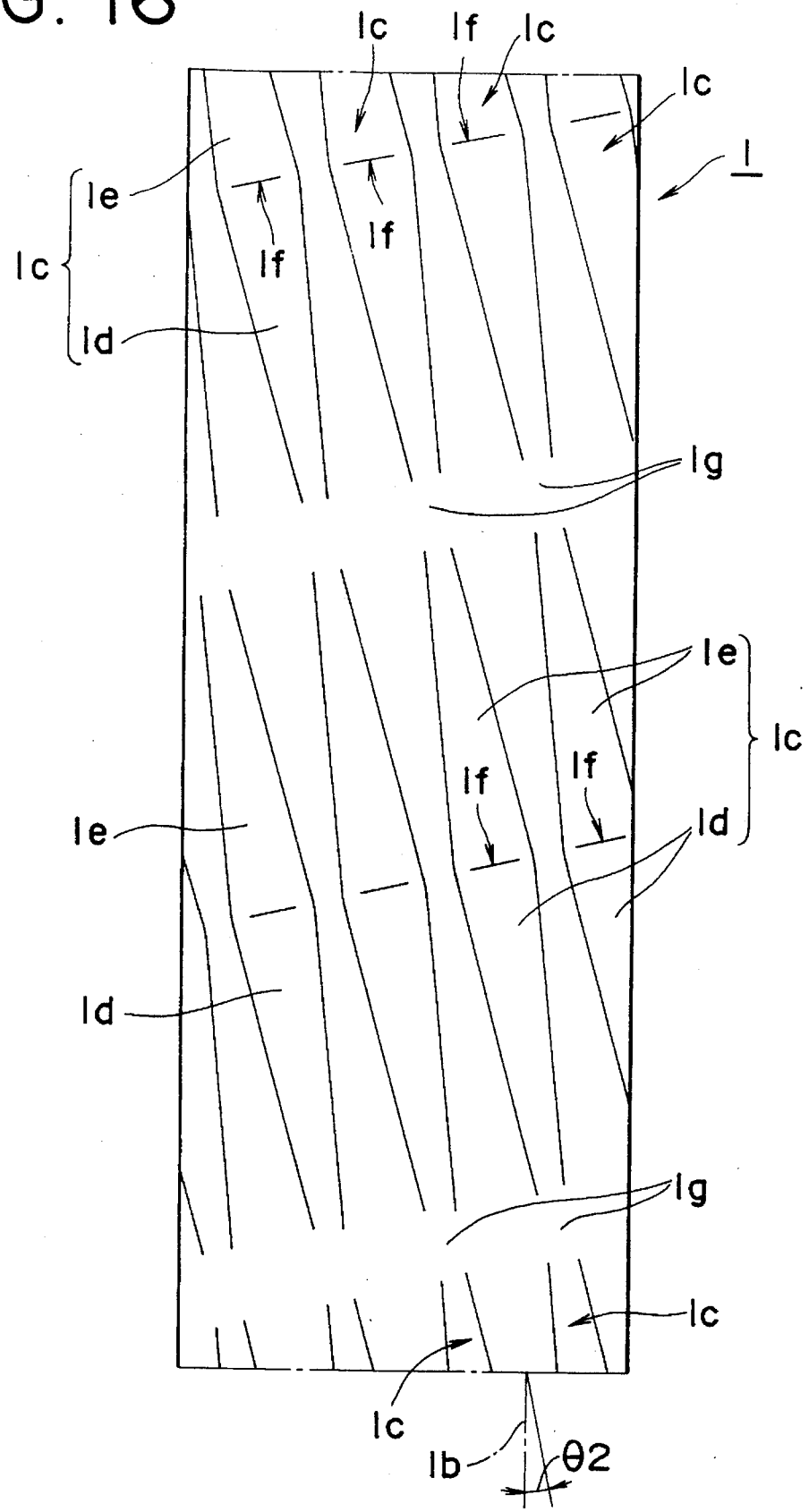
FIG. 16 is a partially development plan view showing a heat transfer tube as a yet further embodiment of the present invention.
Figure 17:
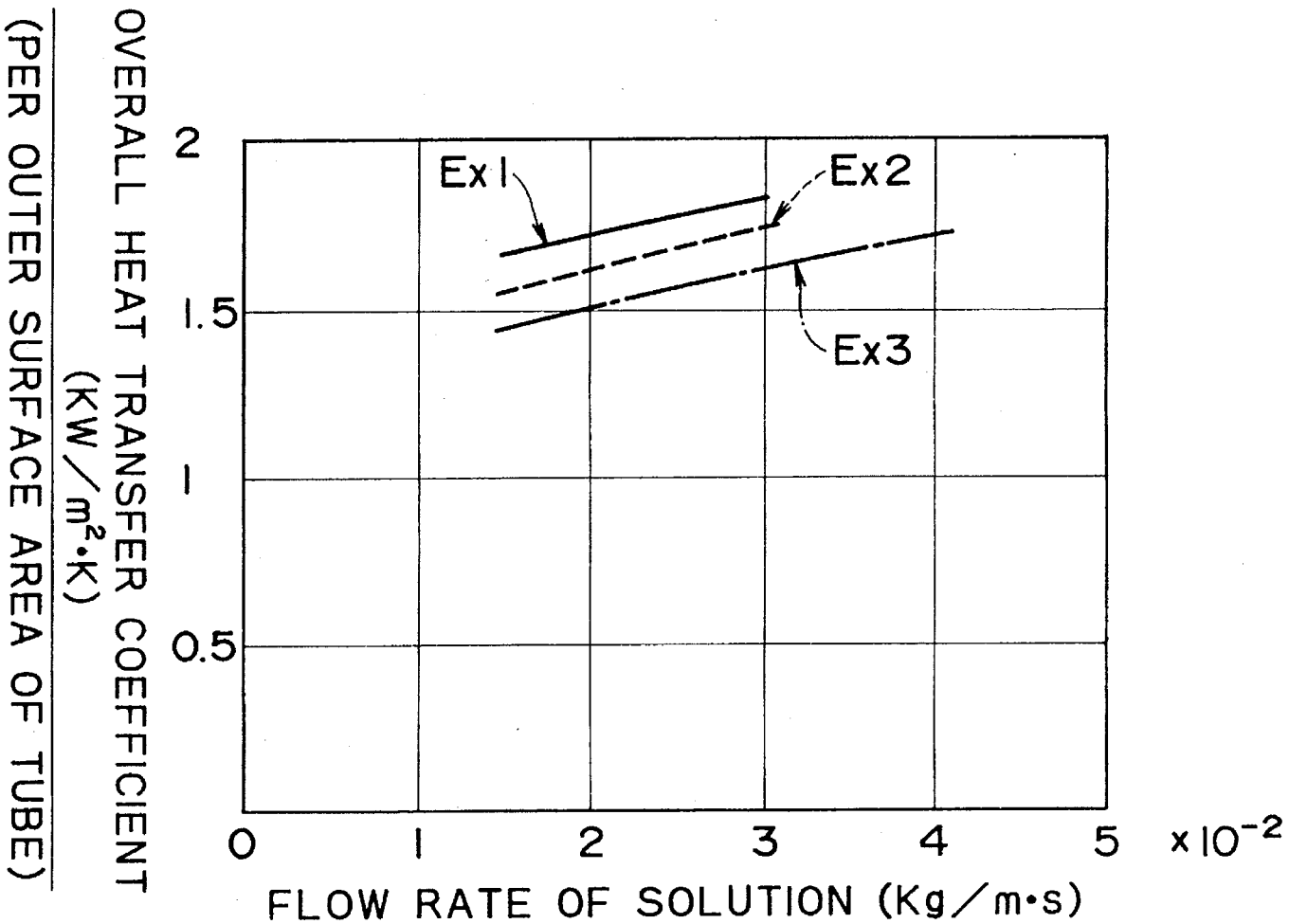
FIG. 17 is a graph showing a comparison in the experimental result of overall heat transfer coefficient between a heat transfer tube as an embodiment of the present invention and a prior art heat transfer tube for an absorber.

FIG. 16 shows a heat transfer tube as a yet further embodiment of the present invention.

The constitution of the heat transfer tube 1 in this embodiment is approximately similar to that of the heat transfer tube shown in FIG. 11, except that each concave portion 1*c* on the surface is formed to have a torsional angle θ 2 of about 14° in the axial direction 1*b* of the tube.

The heat transfer tube shown in FIG. 16 can be manufactured by inserting a blank tube into the space defined by the working rolls 2*a*, 2*a*, 2*b*, 2*b* shown in FIG. 15, which are respectively arranged with an inclination of about 14° from the roll positions shown in FIG. 15.

An advantage of the heat transfer tube shown in FIG. 16 is that the diffusion of the absorbent and the disturbance of the liquid membrane in both the axial and circumferential directions can be accelerated more than those of the heat transfer tube shown in FIG. 11 to hold the liquid membrane on the surface of the tube very satisfactorily. Thus, the heat transfer tube in FIG. 16 further improves in performance.

The torsional angle θ 2 described above is preferably set to be not more than 35° from the viewpoint of performance. Namely, when the torsional angle θ 2 exceeds 35°, there is a possibility of obstructing the diffusion of the absorbent.

Figure 18:
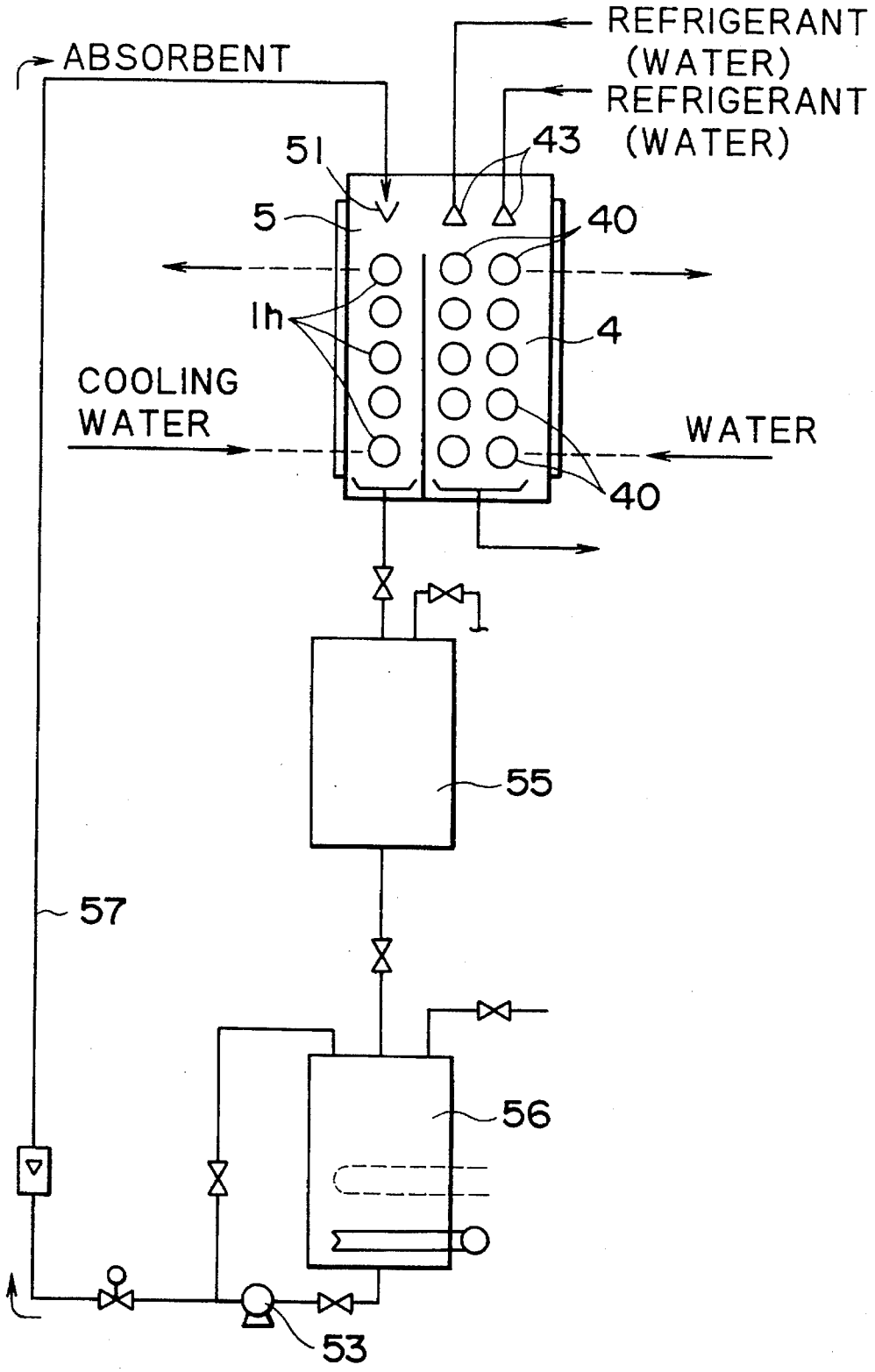
FIG. 18 is a schematic piping diagram showing an apparatus for the experiment of overall heat transfer coefficient shown in FIG. 17.
Figure 19:
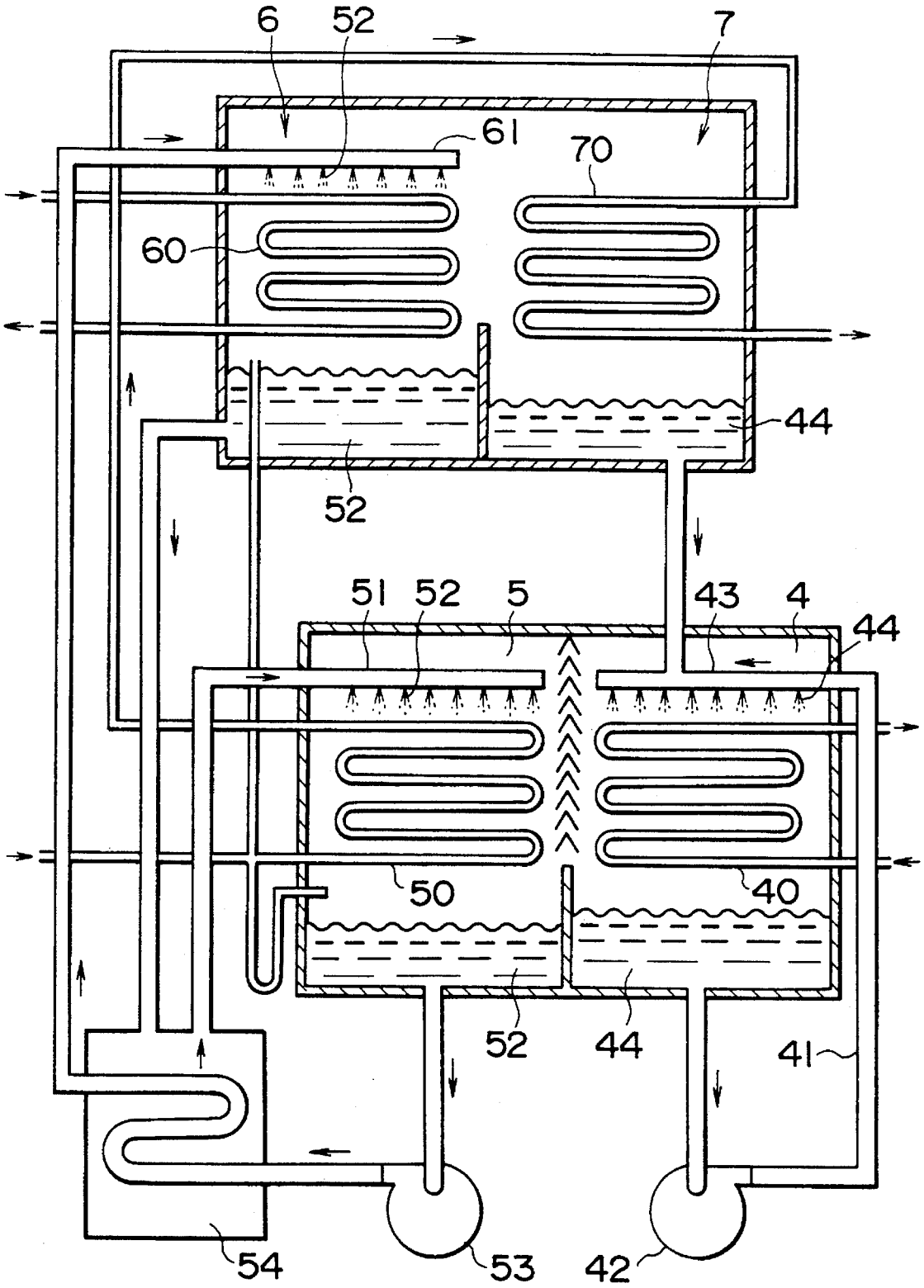
FIG. 19 (PRIOR ART)
FIG. 19 is a schematic view showing a general absorption refrigerating machine in a prior art.

Five pieces of heat transfer tubes were manufactured every each of samples Ex1 through Ex3 as follows. Then, the heat transfer experiment was conducted using an experimental apparatus as shown in FIG. 18 according to the following experiment conditions, in case that each of the samples Ex1 through Ex3 was incorporated as the heat transfer tube into the absorber.

| | Heat transfer tube samples |
|---|---|
| Ex1: | heat transfer tube as the embodiment shown in FIG. 1 |
| Ex2: | heat transfer tube as the embodiment shown in FIG. 11 |
| Ex3: | heat transfer tube according to Japanese Utility Model Laid-open No. 57-100161 provided that: the torsional angle of each groove in the axial direction of the tube is defined as 30° |

-continued

| | |
|---|---|
| depth of groove: | 0.35 mm |
| number of grooves: | 61 |
| outer diameter: | 19.05 mm |
| thickness: | 0.6 mm |
| material: | phosphor deoxidized copper |

| Experiment conditions | |
|---|---|
| (aqueous solution of LiBr) | |
| inlet concentration: | 58 ± 0.5 wt. % |
| inlet temperature: | 40 ± 1° C. |
| flow rate: | 50 to 150 Kg/h |
| addition of surface activator: | none |
| (cooling water of absorber) | |
| inlet temperature: | 28 ± 0.3° C. |
| flow velocity: | 1 m/s |
| pressure in absorber and evaporator: | 15 ± 0.5 mm Hg |
| (arrangement of heat transfer tubes) | |
| Five heat transfer tubes each having a length of 500 mm are arranged vertically in each one row. | |
| absorbant spreading apparatus | |
| bore diameter: | 1.5 mm, |
| interval: | 24 mm |

Explanation for the experimental apparatus shown in FIG. 18.

Reference numeral 4 designates an evaporator, in which five heat transfer tubes 40 were arranged vertically in two rows. The upper and lower heat transfer tubes 40 were communicated with each other to let water run therethrough, and a refrigerant was spread over the heat transfer tubes 40 through a spreader pipe 43.

Reference numeral 5 designates an absorber communicated with the evaporator 4, and five sample tubes 1*h* were arranged in a row inside the absorber. The upper and lower tubes 1*h* were communicated with each other to let cooling water run therethrough, and an absorbent (aqueous solution of LiBr) was spread over the sample tubes 1*h* through a spreader pipe 51.

Reference numeral 56 designates a dilute solution tank for collecting the absorbent diluted with the vapor absorbed in the absorber 5. The absorbent in the dilute solution tank 56 was fed to a concentrated solution tank 57. Lithium bromide was added to adjust the concentration in the concentrated solution tank 57. The resultant absorbent after the adjustment of the concentration was spread over the sample tubes 1*h* through the pipe 58 and the spreader pipe 51 by a pump 53.

The overall heat transfer coefficient of each heat transfer tube sample as the result of the experiment is shown in FIG. 12.

According to the result of the experiment, the heat transfer tube samples Ex1 and Ex2 as the embodiments of the present invention are more excellent in heat transfer performance than the sample Ex3 provided with the helical grooves in the prior art.

While each of the embodiments has been described about a case of using the heat transfer tube for the absorber of an absorption refrigerating machine, the heat transfer tube of the present invention can also be used for the regenerator or the evaporator of the absorption refrigerating machine.

In the heat transfer tube for the absorption refrigerating machine according to the present invention, the diffusion of the medium and the disturbance of the liquid membrane can be substantially accelerated not only in the axial direction but also in the circumferential direction of the tube.

Therefore, since even the small-sized tube can display the high heat transfer performance, it is possible to contribute toward providing a smaller-sized absorption refrigerating machine.

What is claimed is:

1. A heat transfer tube for an absorption refrigerating machine, said tube having a circumferential surface and defining a central axis and comprising:

a large number of concave portions formed in a plurality of circumferential rows on the circumferential surface of the tube at predetermined angular intervals, each concave portion including a gently down-grade surface extending in the direction of and gradually approaching said central axis at an angle of 0.5° to 7°, and a gently up-grade surface continuously extending from said gently down-grade surface in the direction of and gradually diverging from said central axis at an angle of 0.5° to 7°.

2. A heat transfer tube for an absorption refrigerating machine according to claim 1, wherein the gently down-grade surface and the gently up-grade surface of each concave portion are formed symmetrically.

3. A heat transfer tube for an absorption refrigerating machine according to claim 1, wherein said concave portions are formed at the approximately same pitch in the direction of the central axis of the tube.

4. A heat transfer tube for an absorption refrigerating machine according to claim 1, wherein the rows of the concave portions are formed to have a torsional angle of not more than 35° in the direction of the central axis of the tube.

5. A heat transfer tube for an adsorption refrigerating machine according to claim 1 wherein, within each of said concave portions, said gently down-grade surface and said gently up-grade surface meet to define a deepest portion for each of said concave portions wherein said deepest portions of said concave portions within a given row all lie directly beneath a single circumferential line around the tube.

6. A heat transfer tube for an adsorption refrigerating machine according to claim 5 wherein the concave portions in each row overlap and alternate with the concave portions in the next adjacent row.

* * * * *

UNITED STATES PATENT AND TRADEMARK OFFICE

CERTIFICATE OF CORRECTION

PATENT NO. : 5,573,062
DATED : November 12, 1996
INVENTOR(S) : OOBA et al

It is certified that error appears in the above-indentified patent and that said Letters Patent is hereby corrected as shown below:

On the title page, item

"[30] Foreign Application Priority Data", "Dec. 30, 1992" should read --Dec. 30, 1993--.

Col. 12, line 53, after "groove" insert --10--.
Col. 13, line 50, "narrowest" should read --widest--.
Col. 18, line 9, "adsorption" should read --absorption--; and
line 15, "adsorption" should read --absorption--.

Signed and Sealed this

Eleventh Day of November, 1997

*Attest:*

Bruce Lehman

BRUCE LEHMAN

*Attesting Officer*

*Commissioner of Patents and Trademarks*